United States Patent [19]

Wu et al.

[11] 4,141,415

[45] Feb. 27, 1979

[54] METHOD OF RECOVERING HYDROCARBONS BY IMPROVING THE VERTICAL CONFORMANCE IN HEAVY OIL FORMATIONS

[75] Inventors: Ching H. Wu, Golden, Colo.; Alfred Brown; Daniel T. Konopnicki, both of Houston; Joseph C. Allen, Bellaire, all of Tex.

[73] Assignee: Texaco Inc., New York, N.Y.

[21] Appl. No.: 812,077

[22] Filed: Jul. 1, 1977

[51] Int. Cl.[2] ..... E21B 43/24; E21B 47/026

[52] U.S. Cl. ..... 166/252; 166/272; 166/303

[58] Field of Search ..... 166/272, 263, 269, 252, 166/303

[56] References Cited

U.S. PATENT DOCUMENTS

| | | | |
|---|---|---|---|
| 2,897,894 | 8/1959 | Draper et al. | 166/272 |
| 3,221,813 | 12/1965 | Closmann et al. | 166/272 |
| 3,360,045 | 12/1967 | Santourian | 166/269 |
| 3,459,265 | 8/1969 | Buxton et al. | 166/272 X |
| 3,768,559 | 10/1973 | Allen et al. | 166/272 |
| 3,908,762 | 9/1975 | Redford | 166/269 X |
| 3,983,939 | 10/1976 | Brown et al. | 166/269 |
| 4,004,636 | 1/1977 | Brown et al. | 166/272 |
| 4,007,785 | 2/1977 | Allen et al. | 166/272 X |

*Primary Examiner*—Stephen J. Novosad

*Attorney, Agent, or Firm*—Thomas H. Whaley; Carl G. Ries; Jack H. Park

[57] ABSTRACT

A method for recovering viscous hydrocarbons from subterranean formations involves injecting a hydrocarbon solvent into the formation at spaced intervals to produce permeable regions or streaks in the formation. The injection is preferably directed to those regions of highest oil saturation, i.e., those regions with lowest effective permeability. A subsequent introduction of a heated fluid then will enable recovery of the viscous hydrocarbons in the treated regions and the untreated zones therebetween.

10 Claims, No Drawings

METHOD OF RECOVERING HYDROCARBONS BY IMPROVING THE VERTICAL CONFORMANCE IN HEAVY OIL FORMATIONS

BACKGROUND OF THE INVENTION

The instant invention is concerned with a method for increasing the recovery of hydrocarbon products from formations containing viscous petroleum by improving the vertical conformance of said heavy oil formations. In particular, the method of this invention provides a technique for recovery of viscous hydrocarbons from subterranean formations by selectively treating intervals of the formation for purposes of establishing spaced regions for heat treatment within the formation.

Successful production of hydrocarbon products from formations containing viscous hydrocarbons cannot be undertaken by conventional methods. Formations containing viscous hydrocarbons and, in particular, formations containing tar sand or bituminous sands are known to exist in Canada, Western United States, Venezuela and, to some extent, in Europe and Asia. One such formation is the Athabasca tar sand deposit located in the Province of Alberta, Canada.

Typically, tar sand deposits consist of fine quartz sand coated with water and saturated with a very viscous hydrocarbon. The remainder of the space in the deposit may be filled with connate water and, in some deposits, may contain small amounts of air or methane.

Generally, the grains of sand comprise approximately 80 to 85 percent weight of the entire tar sand deposit and this corresponds to a void volume of approximately 35 percent.

Viscous hydrocarbons and water comprise approximately 15 to 20 percent by weight of the tar sand deposit. The quantity of viscous hydrocarbon may vary from about two percent to about 16 percent. The gravity of the viscous hydrocarbon in tar sand formation may range from about 6° to about 8° API and the specific gravity of this material at 60° F. is from about 1.006 to about 1.027.

Strip mining is one method which may be employed to recover viscous hydrocarbons contained in tar sand deposits. However, this method of recovery is economically feasible only when formations to be produced are relatively close to the surface, i.e., when the ratio of the overburden thickness to the tar sand deposit thickness is about 1 or less. In many cases when the tar sands are located at greater depths, and this ratio is greater, other economical means of recovery must be utilized. In such recovery techniques well bores are drilled into the formation. Some of these wells are treatment or injection wells in which fluids may be injected to push or sweep the viscous hydrocarbons to another production well bore from which it is recovered. Alternatively, the treatment fluids may be introduced into a formation with the purpose of causing the viscous hydrocarbons to flow into the same well bore from which they may be recovered.

Generally, viscous hydrocarbons are found in two types of formations, referred to as homogeneous and nonhomogeneous formations. In a homogeneous formation, the percentage of hydrocarbon or petroleum product is very uniform over the entire formation. The difference in the overall hydrocarbon content of different intervals or regions of the formation may vary by about 2 to about 5 percent in such formations. In contrast, nonhomogeneous formations may contain sands that have a wider range of oil saturation.

In nonhomogeneous formations, because of the variation in hydrocarbon content in the various intervals or zones, the formation permeability is not constant. Even in homogeneous formations the permeability may vary, but usually not to the same extent as in nonhomogeneous formations.

In viscous petroleum formations, and particularly in tar sand formations, a successful in situ method for recovery of hydrocarbons frequently involves reducing the viscosity of the hydrocarbons or petroleum in the formation by application of heat to the formation. Upon application of heat, the hydrocarbons become flowable whereupon the hydrocarbons will flow or may be driven out of the formation to a production well from which the hydrocarbons may be recovered. Heat is applied to the formation frequently by injecting a heated fluid, e.g., steam, into the formation to raise the formation temperature. Alternatively an in situ combustion may be initiated to apply heat to the viscous hydrocarbons and improve flowability. In a formation of varying permeabilities, however, the steam will typically invade those areas of high permeability successfully applying heat and reducing the viscosity of the hydrocarbons in the environs of the high permeability regions. In some viscous petroleum formations and tar sand formations, steam will actually form an emulsion barrier at the point where it encounters the formation thus precluding the invasion of steam to large areas of the formation and inhibiting successful recovery.

One condition encountered in steam flooding of viscous petroleum formations has been termed "steam override." In this condition the steam introduced via an injection well does not significantly penetrate the formation at its lower level; rather, the steam has more of a tendency to move upwardly and across the upper level of the formation to the production well. By following such a path the steam serves to reduce the viscosity of only a small amount of the valuable hydrocarbon in the formation and recovery is poor.

The prior art has accordingly attempted to solve these problems by pretreating the formation prior to the application of heat. For example, low molecular weight hydrocarbons such as propane or pentane and the like are injected into the formation to partially dissolve the viscous hydrocarbon or bitumen and create a region more readily permeated by the heated fluid. In these applications, however, the injected hydrocarbon solvent will again tend to flow through the formation by taking the path of least resistance. Accordingly, permeability is enhanced in those regions that originally were most permeable. As can be readily appreciated, such a condition will exist to a significant extent in nonhomogeneous formations, although the permeability gradient in homogeneous formations can be sufficiently significant to leave a large portion of the hydrocarbon or bitumen unswept from the formation following the heat treatment.

Many methods for the recovery of hydrocarbons have been described including water flooding, gas pressurization, in situ combustion and miscible flooding. For example, U.S. Pat. No. 2,862,558 discloses a method for the recovery of hydrocarbons from tar sands which comprises treating the tar sand formation with a mixture of steam and kerosene or a liquid hydrocarbon. U.S. Pat. No. 3,354,958 discloses a two step method for the recovery of oil which comprises first injecting steam and then injecting a volatile hydrocarbon. U.S. Pat. No. 3,608,638 describes a method for the recovery of heavy oil from tar sand formations which comprises injecting a heated hydrocarbon solvent into the upper portion of the deposit and heating the tar sand oil below said upper level.

Other patents such as U.S. Pat. Nos. 3,954,141, 4,004,636 and 4,007,785 disclose methods for the recovery of petroleum from viscous petroleum-containing formation by utilizing a multiple solvent injection into the formation. In particular U.S. Pat. No. 4,004,636 combines a multiple solvent treatment of the formation with a thermal treatment of the formation to recover heavy oils.

Another patent, U.S. Pat. No. 3,147,803, discloses a secondary recovery method wherein a multiple solvent method is employed. The disclosed method was directed to the recovery of hydrocarbons from reservoirs having strata of different permeabilities. The patent disclosed that the solvents would inherently be displaced into the strata in proportion to the permeability of the strata.

All of the above-described techniques are directed to methods for treating the entire formation in some manner in order to recover viscous hydrocarbons; however, the importance of improving the vertical conformance of a formation to recover hydrocarbons apparently was not recognized.

Because of solvent cost, rising energy cost and the rapid depletion of natural energy sources, a process for the recovery of viscous hydrocarbons is therefore desirable to provide a recovery technique which minimizes the loss of solvent while producing high recovery of hydrocarbon.

SUMMARY OF THE INVENTION

The instant invention provides a method for secondary recovery of hydrocarbons from a subterranean formation. This method is particularly adaptable to be used in the recovery of petroleum stock from formations containing viscous hydrocarbons or tar sands of the type found in the Athabasca tar sand deposit in Canada. In the method of this invention the hydrocarbon deposit is accessed via one or more wells penetrating the hydrocarbon deposit. As will be appreciated by those skilled in the art, a plurality of injection or treatment wells are spaced with respect to production wells so that hydrocarbons in the formation may be swept from the injection wells to the production well. Alternatively, but less frequently, a single well may be used for injection and production of hydrocarbons when the formation will readily permit the flow of the hydrocarbons into the bore of the injection well.

The formations in which the methods of this invention are preferably employed have an oil saturation (based on formation pore volume) of 50 percent or more. Formations having such a high degree of oil saturation are relatively impermeable to steam flood, and hence require treatment for successful application of heat.

The instant invention specifically involves injecting a hydrocarbon solvent, as a liquid, into at least two nonadjacent intervals of a formation containing viscous hydrocarbons or tar sands. The injection of the hydrocarbon solvent into specific regions of the formation will create regions of increased effective permeability in the formation. These regions of increased effective permeability may be thought to be generally horizontal, although of course the flow of the solvent will be diverted from the horizontal due to gravity and due to the characteristics of the formation encountered.

After the hydrocarbon is injected into the spaced and nonadjacent intervals of the formations, a heated fluid is injected into a section of the formation spanning at least two of the nonadjacent intervals. This heated fluid, e.g., steam, may readily invade the formation through the zones of high permeability created by the solvent to heat the viscous hydrocarbon and reduce their viscosity. Generally the steam will tend to move upwardly from the permeable regions into which it is injected. Since the increased effective permeability of the treated regions permits the steam to invade the formation to a significant extent, the upward movement of steam into the untreated (and perhaps less permeable) intervals will be effective.

In choosing the spacing between the intervals in which the hydrocarbon solvent will be injected, it is desirable to space these intervals by a distance which will permit thermal communication from the regions of solvent injection to the zones in between them. Accordingly, the heated fluid injected into the well will, primarily by conduction, serve to heat a larger volume of viscous hydrocarbon and thereby increase the efficiency of the recovery operation. The solvent injections are intended to create bands or streaks of relatively higher permeability. These bands will then alternate with untreated zones having lower effective permeability. Generally the thickness of these untreated zones should be such that thermal communication to the untreated zone can be achieved from the more permeable solvent-treated region. Solvent injection spacings of from about 10 to 30 feet may be used depending upon the impermeability of the formation to heated fluid. Establishment of untreated zones having a thickness between 10 and 15 feet is usually satisfactory.

In accordance with this invention there is provided a method which enables the recovery of viscous hydrocarbons from formations characterized by varying levels of permeability.

Further in accordance with this invention there is provided a method which enables recovery of viscous hydrocarbon from subterranean formations with minimal loss of solvent while producing a high recovery of hydrocarbons.

In accordance with this invention the solvent treatment is conducted by isolating the casing in a well bore hole opposite the spaced intervals to be treated and injecting the hydrocarbon solvent at elevated pressure into the regions opposite the isolated and "packed off" regions of casing. The spacing between the injection intervals will be largely selected based upon the characteristics of the formation as predetermined from core samples, logs or the like. With such information, it is possible, using the method of this invention to direct the hydrocarbon solvent to the areas of lowest effective permeability (and highest oil saturation) thereby increasing the injectivity in these areas to the heated fluid, and thus enabling heat application to the entirety of the formation.

The spacing between the intervals will also be largely dependent upon the nature of the formation. It is highly desirable to space the solvent injection point so as to create regions of high permeability which are sufficiently proximate to each other that thermal communication to the zone there between can be readily achieved. Heat application to the zones adjacent to treated zones can be accomplished by conduction of heat through the formation via adjacent regions of high permeability.

The solvents which may be utilized for the effective treatment of the formations in accordance with this invention to create high permeability regions are typically selected from the group comprising paraffinic hydrocabons, mononuclear aromatic hydrocarbons, naphtha, and mixtures thereof.

DESCRIPTION OF THE PREFERRED EMBODIMENTS

In accordance with this invention, recovery of viscous hydrocarbons can be accomplished by injecting a solvent into spaced regions of a formation and subsequently heat treating the entire formation, i.e., a region spanning two or more injection regions, to decrease the viscosity of those viscous hydrocarbons and enable recovery of them from the formation. In nonhomogeneous formations, it is preferred to first determine by core analysis or logging the intervals within the formation having the highest degree of oil saturation and hence the lowest permeabilities. These regions are then solvent treated to increase the effective permeability of those regions and improve the overall vertical conformance of the formation. A heated fluid such as steam may thereafter be injected with minimum inefficiency caused by steam override.

Further in accordance with this invention, homogeneous formations of generally low effective permeability and correspondingly high oil saturation (i.e., typically greater than 50 percent), are treated by injecting solvent into these low effective permeability regions at spaced intervals to create permeable streaks or bands in the formation extending generally outwardly from the injection site. The spacing of these injections is chosen to enable the heated fluid to establish thermal communication with the untreated zones there between. The subsequently injected heated fluid will then invade these artificially created permeable streaks. Subsequent steam injection of a part of the formation spanning these treated regions will apply heat to the hydrocarbons within the treated areas and the untreated zones between them. The heating of the viscous hydrocarbons within the formation generally reduces the viscosity of the hydrocarbons, which in turn improves permeability. Thus it may be seen that the methods of this invention permit recovery of viscous hydrocarbons from formations having high oil saturation and low effective permeability utilizing minimum solvent and achieving a maximum of efficiency.

It will be understood that the creation of permeable streaks may be used in broad bands of low effective permeability in a nonhomogeneous formation to improve recovery in that region with minimum utilization of solvent.

In accordance with this invention it is preferred to first determine a permeability profile of the formation by core analysis, logging or the like to identify the low permeability intervals in the formation. The term "low effective permeability interval" is intended to refer to those regions which present significant resistance to invasion by steam, and which generally will be characterized by an oil saturation level of about 50 percent or more. After this determination, the tubing string is then packed off to create solvent injection points at spaced intervals within these low effective permeability zones. For example, if an entire formation exhibits a substantially homogeneous character identified by a sand having a depth of 120 feet, the solvent injections should be spaced over that 120 foot interval as explained below. If, however, a 200 foot hydrocarbon containing sand is nonhomogeneous and is identified by two low effective permeability regions having thickesses of about 60 feet, spaced injections may be made within those 60 foot intervals. It is preferred to introduce the solvent at locations where the formation has been previously prepared, for example by fracturing or perforating to assist in achieving a horizontal-type solvent invasion which will produce generally parallel streaks of lower relative permeability.

The solvent injections are typically accomplished by packing off the outer casing penetrating the formation to create spaced injection points at which communication exists from the inside of the casing to the formation. Solvent may then be introduced through an interior tubing which enables the solvent to be injected from spaced packed-off intervals within the casing.

The intervals between treated regions should be so spaced that there can be effective heat application to intervals there between. Typically the lowest solvent injection point is located at the bottom of the low permeability sand. Spacings of the upper solvent injections then may vary from between about 10 to 20 feet across the low permeability region. Once a permeable streak is created, steam injection into this region will result in the steam tending to rise from the artificially created permeable streak to heat the untreated region above. The heating action in turn decreases viscosity and increases the effective permeability of the untreated zone assisting further steam penetration.

Application of the heated fluid following solvent treatment is not preferably undertaken from spaced injection points but is applied across a section of the formation spanning the plurality of injection points across the zone of low permeability or across the entire formation. This permits steam invasion through the artificially created streaks and through any higher permeability crevices which might exist.

The solvent injection is accomplished using any of a number of hydrocarbons which will pass into solution with the viscous hydrocarbons in the formation. For example, paraffinic hydrocarbons, particularly the lower alkanes having one to six carbon atoms may be used. Alternatively mononuclear aromatic hydrocarbons, or naphtha may be used. Mixtures of these hydrocarbons may also be employed. In this regard it is preferred to utilize a mixture of one solvent component and one vaporizable component which will vaporize upon application of heat. The vaporizable component increases greatly in volume, provides a drive for the hydrocarbons and serves to open communication channels in the formation. Propane and butane serve admirably as a solvent mixture, the former acting as the vaporizable component. Reference may be had to U.S. Pat. No. 4,004,636 the disclosure of which is incorporated herein, for disclosure of use of such hydrocarbon solvents.

In this regard the solvent treatment using a solvent component and a vaporizable component may be undertaken in stages by injection of the solvent component, e.g. butane, into the formation followed by the vaporizable component, e.g. propane. When such a procedure is employed, the heated fluid encounters the vaporizable component causing it to vaporize and sweep the solvent and viscous hydrocarbon to the production well. The vaporized propane tends to push the butane ahead until the propane recondenses upon encountering a lower temperature area of the formation. Additional steam then revaporizes the propane to continue the sweeping action.

The injection of steam into the entire formation is accomplished by moving the packers which were utilized during the solvent treating process from their former positions. In the steam injection step, only two packers in the tubing are required, one above the formation and one below. By casing the packers steam can be injected into the entire formation. Alternatively, the steam can be injected into a portion of the formation spanning a plurality of the treated intervals. As previously indicated steam should be injected at a pressure below the overburden fracture pressure. As an alternative to steam injection, in situ combustion, as well known in the art may be employed to drive hydrocarbons to the production well.

The injection of the solvent is made at a pressure such that the mixture is a liquid when injected. During injection it is likely that the volumetric injection rate of the solvent will decrease with time if the injection pressure is maintained at a constant value. The injection pressure is maintained below the overburden fracture pressure in order to avoid fracturing the formation.

The injection rate may decrease to a negligible rate without communication having been established with the well from which production is to be made. As the solvent is injected, it dissolves the viscous petroleum and may encounter such resistance that communication cannot be established without increasing the injection pressure above the overburden fracture pressure. In such a case, the injection is stopped and the pressure at the injection wellhead may be reduced to allow some production of hydrocarbons and solvent from the injection well. Once this production rate from the injection well slows to a negligible value, the solvent treatment of the intervals can be initiated again.

A series of injections of the solvent and depletions of the pressure at the injection wellhead may be required before communication is established with the well from which production is to be made. Once communication is established with the production well, as evidenced by the production of some hydrocarbon from the production well, a heated fluid, preferably steam, may be injected into the entire formation through the injection well.

Alternatively, the heated fluid may be injected into each of the treated intervals simultaneous or in a series, or the fluid may be injected into the entire formation. As with the solvent injection pressure, the heated fluid should be introduced at a pressure below the overburden fracture pressure. The heated fluid may be injected into each treated interval alone. By injecting in this fashion, it is thought that some of the solvent will vaporize and drive the viscosity reduced hydrocarbon or petroleum to the production well. Also, some of the solvent will be driven to the untreated intervals and reduce the viscosity of the hydrocarbon in those intervals. The heat from the fluid will raise the temperature of hydrocarbons in the adjacent untreated intervals and reduce the viscosity of these hydrocarbons. This reduction in viscosity in turn improves the effective permeability of these untreated zones thus permitting further steam invasion.

In the preferred embodiment, where a mixture of a vaporizable component and a solvent component have been injected during the treatment step, the heated fluid should be introduced at a temperature sufficient to vaporize at least a portion of the vaporizable component of the mixture. Preferably, the heated fluid should be introduced at a temperature of at least 50° F. greater than the vaporization temperature of the vaporizable component at the formation pressure. The vaporization of at least a portion of the gaseous component leaves an amount of the solvent to dissolve in the viscous hydrocarbon thereby lowering the viscosity of the hydrocarbon, and the volumetric expansion resulting from the vaporization of the gaseous component opens pores of the formations and maintains communication channels. At the production well, at least a portion of the solvent injected can be recovered and recycled.

The gaseous component of the solvent can be removed from the viscous hydrocarbon-solvent mixture by a suitable pressure reduction step. If the gas is to be reused then a compressor or other suitable means will be required to raise the pressure of the gaseous component.

The remaining solvent may be separated from the viscous petroleum by thermal distillation; however, if the viscous hydrocarbon is to be further processed at some other location it may be desirable to leave the solvent in solution with the viscous hydrocarbon in order to facilitate its transport.

By first treating the low effective permeability intervals with a suitable solvent and thereafter subjecting the formation via the injection well to a suitable thermal treatment, a larger quantity of the viscous hydrocarbons can be produced from the formation than if other methods were used. Other methods are not as effective since they treat the entire formation and not selected intervals.

The method of this invention may be practiced on homogenous formations as well as nonhomogeneous formations. For example in homogenous formations, this invention may be practiced as a remedial step after steam flooding has been unsuccessful or it may be used before steam flooding to prevent steam override. In some cases where steam flooding has been practiced in heavy oil formations, an override condition may be created. As a result of this condition, a great quantity of petroleum is left in the formation which cannot be recovered by further steaming or by other economical means. However, by the practice of this invention, the hydrocarbons left in the formation can be recovered by improving the vertical conformance of the formation.

This is done by selectively treating at least two nonadjacent intervals in the formation with a solvent, a mixture of solvents, or a series of solvent injections.

If the prior steam flood was not introduced at the lowermost point in the formation then the method of the instant invention can be practiced as previously described. If steam was injected at the lowermost point then the function of the production and injection wells may be reversed. That is, solvent and thermal treatment as previously described may be undertaken via the production well and production may be made through the injection well. This reversal is required since further injection through the injection well will merely flow through the previously formed channel.

In either instance, the intervals to be treated are selected as previously described. If there is no discernible difference in oil saturation throughout the formation, then a plurality of spaced nonadjacent intervals may be treated in accordance with this invention.

In homogeneous formations as in nonhomogeneous formations, the horizontal permeability is greater than the vertical permeability; however, the difference in these permeabilities is not as great in homogeneous formations. Accordingly, there is a greater tendency in homogeneous formations than in nonhomogeneous formations for solvents to travel vertically rather than horizontally into the formation. This tendency can be reduced by treating the homogeneous formations with a solvent having a high density. With a higher density solvent the difference in density between the solvent and the viscous hydrocarbons is less and, hence, the tendency to travel vertically rather than horizontally can be reduced. Accordingly, this invention may be practiced in homogeneous as well as nonhomogeneous formations.

With regard to the treatment step of the instant invention, it is to be understood that the treatment may be comprised of the injection of a single solvent, a mixture of solvents or a series of two solvent injections in which the second solvent injected is more volatile than the first. Where one solvent is used, it may be selected from a group consisting of paraffinic hydrocarbons having at least one carbon atom, mononuclear aromatic hydrocarbons, naphtha and mixtures thereof. When a series of solvents are used, the first solvent is selected from a group consisting of paraffinic hydrocarbons having at least four carbon atoms, mononuclear aromatic hydrocarbons, naphtha, and mixtures thereof; and the second solvent is selected from a group consisting of methane, ethane, propane and mixtures thereof.

Regardless of the solvent or solvents which are injected, it is preferred that they be injected as liquids. By solvent treating in this fashion, the liquid hydrocarbons appear to be more capable of dissolving the viscous heavy oils or hydrocarbons in the formation and thereby reducing their viscosity.

With regard to the heated fluid which may be injected, it should be understood that the fluid utilized may be selected from the group consisting of steam and mixtures of steam with inert gases or solvents. The inert gases which may be utilized are selected from a group consisting of air, nitrogen, carbon dioxide and mixtures thereof; and the solvents which may be utilized are selected from a group of hydrocarbons consisting of methane, ethane, propane, butane and mixtures thereof. Since there exists a pressure limitation on the steam pressure which may be used, i.e., the overburden fracture pressure, the temperature of the injection will largely be determined. For example at 400 psia, the temperature of saturated steam is approximately 445° F.

The formations in which the invention may be practiced may have one or more wells drilled into and in communication with the formation. With only one well drilled into the formation this invention may be practiced in said formation in a "push-pull" manner. In this embodiment the intervals are chosen in a manner as previously described and they are solvent treated. The solvent treatment may continue until the permeability of the intervals is increased to or above that of adjacent intervals of a nonhomogeneous formation. The amount of treatment may vary depending on the particular formation. After solvent treatment, thermal treatment can be initiated to further reduce the viscosity of the formation heavy oil. The time spent during the thermal treatment step may vary depending on the nature of formation and on other factors well-known to those skilled in the art. After the thermal treatment, the pressure of the well is reduced to allow production of the viscosity reduced heavy oil.

It should be understood that in any embodiment the object is to obtain the maximum production of hydrocarbons and the maximum solvents recovery at the lowest cost.

The description of the particular and preferred embodiments was not intended to limit the scope of this invention. Various modifications of the disclosed embodiments, as well as other embodiments of the invention, may be apparent to persons skilled in the art upon reference to this description. It is therefore contemplated that the appended claims will cover any such modifications or embodiments as fall within the true scope of the invention.

What is claimed is:

1. A method for recovering viscous hydrocarbon crude stock from a subterranean formation penetrated by at least one well borehole which comprises:

determining the location of those regions of low permeability within said formation having an oil saturation of greater than 50 percent;

injecting a hydrocarbon solvent into said formation at intervals within said low permeability regions, said intervals being spaced to permit thermal communication of a heated fluid from said intervals to the zones of the formation therebetween;

injecting a heated fluid into a region of said formation spanning a plurality of solvent injection intervals; and recovering crude stock from a well penetrating said formation.

2. The method of claim 1 wherein said solvent is injected as a liquid and is selected from the group consisting of paraffinic hydrocarbons having at least one carbon atom, mononuclear aromatic hydrocarbons, naphtha and mixtures thereof.

3. The method of claim 2 wherein said solvent is a mixture of propane and butane.

4. The method of claim 1 wherein said hydrocarbon solvent injection comprises the steps of:

injecting said intervals with a first solvent; and injecting said intervals with a second solvent which is more volatile than the first.

5. The method of claim 4 wherein said first solvent is selected from the group consisting of paraffinic hydrocarbons having at least four carbon atoms, mononuclear aromatic hydrocarbons, naphtha, and mixtures thereof; and wherein said second solvent is selected from the group consisting of methane, ethane, propane and mixtures thereof.

6. The method of claim 1 wherein said heated fluid is selected from a group consisting of steam and mixtures of steam with inert gases or solvents.

7. The method of claim 6 wherein said heated fluid is a mixture of steam and an inert gas selected from the group consisting of air, nitrogen, carbon dioxide, and mixtures thereof.

8. The method of claim 6 wherein said heated fluid is a mixture of steam and a solvent selected from the group consisting of methane, ethane, propane, butane and mixtures thereof.

9. The method of claim 6 wherein said heated fluid is steam.

10. A method for recovering viscous petroleum from a subterranean, permeable, viscous petroleum-containing formation penetrated by at least one injection and one production well, said formation being comprised of a plurality of horizontally oriented layers of different permeability, at least two of said layers being nonadjacent and having oil saturations greater than 50 percent and also substantially greater than the oil saturation of other zones in the formation, the permeability of said layers being substantially less than the permeability of the other layers of the formation, comprising (a) identifying the layers having more permeability and higher oil saturation within the formation;

(b) establishing fluid communication between the injection well and at least one portion of each of said layers having higher oil saturation and lower permeability than the other layers;

(c) injecting a hydrocarbon solvent into said portions of said layers having higher oil saturation and lower permeability;

(d) thereafter establishing communication between the well and at least a portion of the remainder of the formation including zones of lower oil saturation and higher permeability than the zones into which solvent was selectively injected in step (c) above;

(e) thereafter injecting a fluid comprising steam into the portions of the formation with which communication is newly established in step (d) and into the portions of the formation into which solvent was selectively injected in step (c) above, said steam displacing petroleum through the formation; and (f) recovering petroleum displaced by the steam via the production well.

* * * * *